US006357626B1

(12) United States Patent
Zhang et al.

(10) Patent No.: US 6,357,626 B1
(45) Date of Patent: Mar. 19, 2002

(54) PRE-FILLED ORAL LIQUID DISPOSABLE PLASTIC CONTAINER

(76) Inventors: Jack Yongfeng Zhang; Anthony D. Marrs; Mary Ziping Luo, all of 11570 Sixth St., Rancho Cucamonga, CA (US) 91730

( * ) Notice: Subject to any disclaimer, the term of this patent is extended or adjusted under 35 U.S.C. 154(b) by 0 days.

(21) Appl. No.: 09/798,049

(22) Filed: Mar. 5, 2001

(51) Int. Cl.[7] ..... A61J 7/00

(52) U.S. Cl. ..... 222/78; 222/212; 222/215; 222/420; 222/541.1

(58) Field of Search ..... 222/78, 209, 212, 222/213, 215, 420, 541.1; 141/22–24, 26

(56) References Cited

U.S. PATENT DOCUMENTS 2,802,605 A * 8/1957 Parker ..... 222/215
2,966,284 A * 12/1960 Lewis ..... 222/209
3,105,612 A * 10/1963 Krasnoff et al. ..... 222/78
3,128,920 A * 4/1964 Volckening et al. ..... 222/215
3,154,116 A * 10/1964 Mitchell ..... 141/24
3,174,655 A * 3/1965 Hurschman ..... 222/215
3,189,223 A * 6/1965 Mackal ..... 222/420
3,215,142 A * 11/1965 Buono ..... 222/209
4,248,227 A * 2/1981 Thomas ..... 222/541.1
4,789,082 A * 12/1988 Sampson ..... 222/213
4,966,312 A * 10/1990 Waring ..... 222/209
5,226,572 A * 7/1993 Gargione ..... 222/420
5,678,736 A * 10/1997 Hansen ..... 222/209
5,724,021 A * 3/1998 Perrone ..... 340/309.15
6,241,124 B1 * 6/2001 Hoyt ..... 222/215
6,267,270 B1 * 7/2001 Schaffner ..... 222/209

* cited by examiner

*Primary Examiner*—J. Casimer Jacyna
(74) *Attorney, Agent, or Firm*—Albert O. Cota

(57) ABSTRACT

A pre-filled oral liquid disposable plastic container along with its storage means are provided to deliver medication to a patient in a easy to use and sanitary manner. The plastic container (20) includes a hollow bulb portion (22) on one end and a hollow stem portion (24) on the other. A bulbous flange (26) is integrally formed onto the distal end or the hollow stem, thus permitting comfortable insertion of the container into a patient's mouth. A specified quantity of liquid medication (28) is pre-filled into the container with the container sized appropriately. The plastic in the container is colored, thereby indicating the type of liquid medication, and permitting the medication to be colorless and still maintain its identity. All of the containers have a recognizable shape on the bulb portion, such as a cylinder with spherical ends for adult medicine, or in some shape attractive to infants and small children. A metallic foil closure (30) is attached to the distal end of the container for sealing the liquid medication within, and a tab (32) is included for ease of removal.

13 Claims, 4 Drawing Sheets

PRE-FILLED ORAL LIQUID DISPOSABLE PLASTIC CONTAINER

TECHNICAL FIELD

The invention relates to plastic containers in general, and more specifically, to a plastic container with pre-filled liquid medication for oral administration.

BACKGROUND ART

Some of the most effective types of containers are those manufactured from plastic. Plastic containers are capable of storing many different types of materials, and are especially effective for medicines. Because plastic can be molded into almost any shape, certain medicines can be sold and stored along with an applicator, such as a dropper.

One of the most convenient methods of administering medicine in small amounts is to package the medicine in a pre-filled, pre-determined amount. This not only makes the administering of the medicine easier, but also helps insure against accidental over-dosing. Unfortunately, many medicines are still packaged and stored by older, conventional means. Obviously, if there were some way of packaging, storing and administering low-dose medicine, in an easy-to-use manner, it would be beneficial to many people.

A search of the prior art did not disclose any patents that possess the novelty of the instant invention, however the following U.S. patents are considered related:

| U.S. Pat. No. | Inventor | Issue Date |
|---|---|---|
| 6,098,676 | Poynter et al. | Aug. 8, 2000 |
| 5,928,662 | Phillips | Jul. 27, 1999 |
| 5,799,837 | Firestone, et al. | Sep. 1, 1998 |
| 5,624,057 | Lifshey | Apr. 29, 1997 |
| 5,609,273 | Firestone, et al. | Mar. 11, 1997 |
| 5,578,020 | Mosley | Nov. 26, 1996 |
| 4,150,744 | Fennimore | Apr. 24, 1979 |
| 4,114,659 | Goldberg et al. | Sep. 19, 1978 |

Phillips in U.S. Pat. No. 5,926,662 teaches a drug delivery device that has a reservoir holding medicine for delivery to a patient. The device has a conduit with one end coupled to the reservoir and a free end to position within the fornix of a patient's eye. Through gravity and capillary action, the medicine flows into the eye with a rate of delivery adjusted according to the size and material of the conduit, The invention has the reservoir made of an absorbent material provided with an impermeable backing which acts as a barrier. In the preferred embodiment, the backing has an adhesive for attaching to the eye of the patient.

U.S. Pat. No. 5,799,837 issued to Firestone, et al. is for a packaged pharmaceutical product having an extended shelf life and includes a container consisting of a hollow body with an open end. The body wall thickness enables drop-by-drop dispensing of a medicine by manually squeezing the container body. A tip is fixed to the body to form droplets for application.

Lifshey in U.S. Pat. No. 5,624,067 discloses an ophthalmic storage and dispensing device formed by injection molding, consisting of a vial with thick rigid walls and a limited flexible area. The flexible area allows only a small displacement when squeezed, providing a metered volume of liquid. The tip has a integral-molded puncture membrane to provide sealing.

Firestone, et al. in U.S. Pat. No. 5,609,273 teaches a barrier package that includes a container with a hollow body and an open end having a body thickness which enables a drop-by-drop dispensing of a medicant by manually squeezing the container. A dropper tip is fixed to the open end and forms droplets upon manual squeezing of the body.

U.S. Pat. No. 5,578,020 issued to Mosley is for an eye drop dispenser and dispensing sleeve. The dropper has a liquid reservoir portion and a dispensing end with a dropper orifice. Part of the reservoir is resilient and a dispensing sleeve circumscribes the dropper tube with a pair of legs that extend beyond the end of the tube. The legs are adapted to fit against the orbital areas of an eye to support the dropper over the eye for application of the liquid.

Fennimore in U.S. Pat. No. 4,150,744 discloses a packaging device for light and oxygen sensitive liquid which includes a dropper spout. The vessel itself is sealed within a gas impermeable envelope under vacuum.

For background purposes and as indicative of the art to which the invention is related, reference may be made to the remaining cited patents issued to Poynter, et al. in U.S. Pat. No. 6,089,676 and Goldberg, et al. in U.S. Pat. No. 4,114,659.

DISCLOSURE OF THE INVENTION

Liquid medicine doses are typically administered using one of three measured quantities: teaspoon, cup or dropper. The dosing amounts are listed on a table located on the outside of a carton or bottle for a given age and/or weight of a person, with the table normally specifying the correct dose. Because of differing methods of administration and the range of doses, the tables can be difficult for the end user to understand. The three delivery methods used for oral medications are as follows:

A spoon is the traditional method of delivery where the user fills the spoon with the prescribed amount of liquid and inserts the spoon into a patient's mouth. The advantage of this method is that spoons are convenient, standardized in size and relatively sterile as they are normally cleaned after each use. A disadvantage is that spoons are shallow, thus making it difficult to not spill the liquid when pouring out the proper amount. Perhaps more importantly, it may be very troublesome to convey the liquid into an unwilling child's mouth without spilling at least some or all of the medication in the process.

Sensing the need for a delivery method that allows administering medication away from the home, manufacturers began marketing products that included a plastic cup with the packaging of the medication. The plastic cup included calibration marks corresponding to the recommended doses and could be reused after washing. The advantage of this system is that it may be used at any location, it is accurate, neat to use, and simple to understand. The downside is that after use the cup may have a coating of medication on the inside and must be washed, this may be problematic if there is no water available at the time. Further, if the cup is not cleaned expeditiously, the remaining contents could become sticky and hard to clean. Another disadvantage is the potential for cross contamination from one user to another.

The dropper method is often used for administration of liquid medicine to infants or small children. The dropper shaft is usually marked for the dosage, for ease of filling from a bottle. The dropper is then placed in the patient's mouth and the bulb is squeezed to release the medication. The dropper is washed and is either placed into a carton or a medication bottle for storage. One advantage is that infants and small children may not be able to drink liquid from a cup therefore, medication may be easily released directly into their mouth. Another advantage is that this method may be used to administer medication to those who may have difficulty in taking pills. The downside is that droppers are difficult to sterilize using tap water exclusively and cross contamination is probable, particularly since the dropper must be inserted into the medication, sometimes multiple times, to obtain the proper dose. Further difficulty can arise when filling the dropper if the bottle is almost empty.

In view of the above disclosure, it is the primary object of the invention is to provide a pre-filled medication in a disposable plastic container, such as a pipette, dropper or other similarly shaped device to orally administer the liquid medication. The container may be sized to accommodate a specific amount of medication for oral administration in one dose.

An important object of the invention is that the container is inherently colored, thus eliminating the need to add dyes to the medication. Typically, medication color is an important consideration for the purchase of the product, as color is representative of the brand or its generic equivalent. Further, the necessity of adding color to the medication is completely eliminated, thereby excluding this step in production.

Another object of the invention is directed to assist parents, or caregivers, ill the administration of medication to infants, as the container may be in an attractive shape such as animated character, which is intended to distract the infant and permit less difficult delivery of the medication.

Still another object of the invention is to provide attractive packaging, as a number of containers are stored in wide mouth, transparent plastic canisters for ease of transport and accessibility.

Yet another object of the invention is that the containers may be manufactured using a wide variety of methods, such as blow-fill-seal, vacuum chamber liquid filling, extrusion and other methods well known in the art.

In addition to the above objects of the invention it is also an object of the invention to provide a pre-filled liquid, disposable plastic container that:

is easy to use for infants and the elderly, is portable, is single use, no cross contamination, has no sharp edges on the container, uses standard labeling of dosages, and uses colored plastic to eliminate the need for dyes in the medication.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
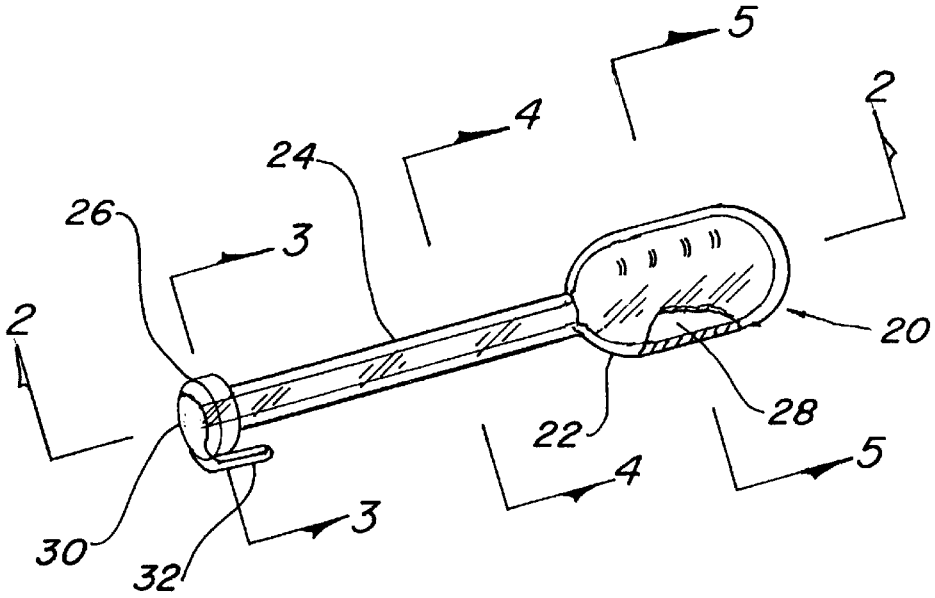
FIG. 1 is a partial isometric view of the preferred embodiment with a hollow bulb portion in cylindrical shape with spherical ends.

The best mode for carrying out the invention is presented in terms of a preferred embodiment. The preferred embodiment as shown in FIGS. 1 through 19, is comprised of a pre-filled, oral liquid medication disposable plastic container 20 that incorporates a hollow bulb portion 22 and a hollow stem portion 24, The container 20 is preferably a resilient pipette or an eye dropper, as shown in FIGS. 1 through 14, however other forms and shapes may be utilized as long as the utility remains the same. In any case the container must be sufficiently resilient to permit the oral liquid medication to be ejected by gently squeezing the bulb portion 22. The container 20 is constructed of a basic thermoplastic material such as polycarbonate, polyethylene, polyester, polystyrene, polypropylene, polysulfone, polyurethane, ethylene-vinyl-acetate and the like. The material may be transparent or translucent according to the color selected.

A bulbous flange 26 is integrally formed on the distal end of the hollow stem 24, as illustrated in FIGS. 1 through 3 and 6 through 13, thus permitting comfortable insertion into a patient's mouth. The flange 26 has smooth radial corners to prevent injury of the patient's mouth, and, when inserted to create a manageable tactile surface on the end.

A specified quantity of liquid medication 28 is disposed within the container 20 in an amount equivalent to one dose. The volume of liquid medication is determined by the strength and potency of the medicine and the amount that is to be taken by a particular patient. This amount is often determined by the patient's age and/or weight, and it becomes simple and easy to regulate this volume by selecting the appropriate overall size of the container.

The container has a specific color, thereby indicating the type of liquid medication contained within. Color pigment is added to the thermoplastic base materials at the time the container 20 is fabricated and, as stated above, may be basically transparent or translucent. It should be noted that the container color represents a specific medication, thus permitting the medication within the container to be colorless and yet recognizable by the user. In today's pharmaceutical industry, particularly for over-the-counter types of medicine, color plays an important roll in identification of a product. Permitting the color to be integral with the container, instead of the medication, is beneficial to the manufacturer. It should be further noted that even an empty colored container still retains its identity.

Figure 2:
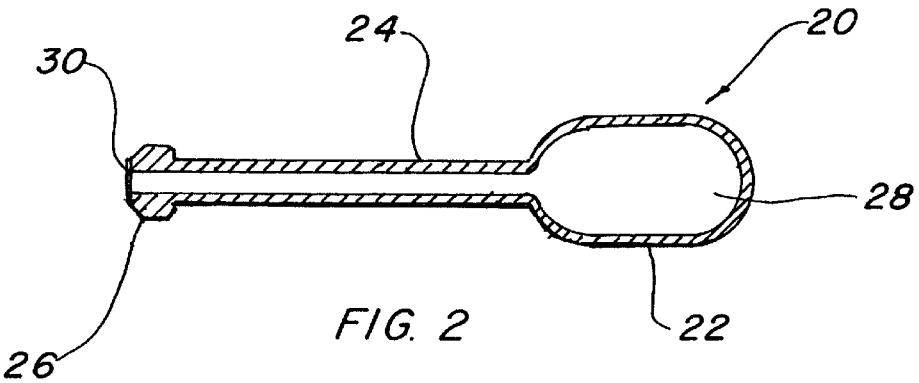
FIG. 2 is a cross sectional view taken along lines 2—2 of FIG. 1.
Figure 3:
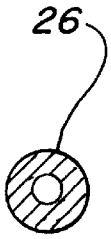
FIG. 3 is a cross sectional view taken along lines 3—3 of FIG. 1.
Figure 4:
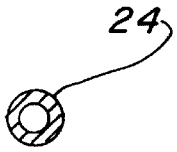
FIG. 4 is a cross-sectional view taken along lines 4—4 of FIG. 1.
Figure 5:
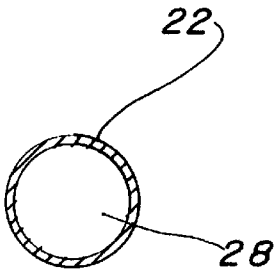
FIG. 5 is a cross sectional view taken along lines 5—5 of FIG. 1.
Figure 6:
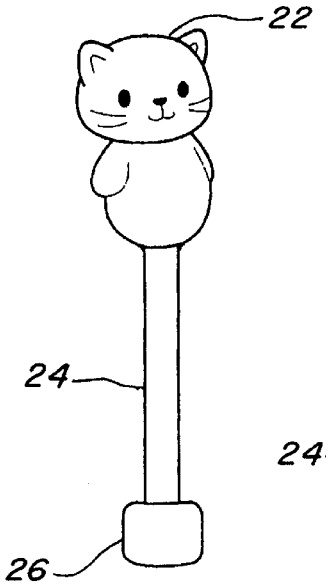
FIG. 6 is a front elevation view of the container with the bulb portion in the recognizable shape of a cat with whiskers.
Figure 7:
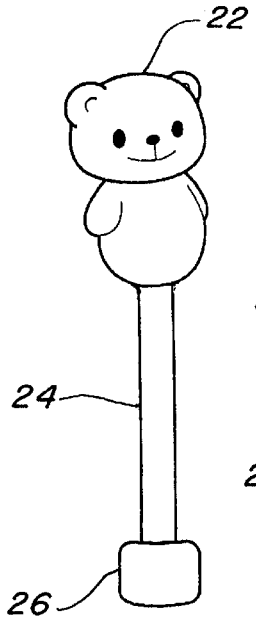
FIG. 7 is a front elevation view of the container with the bulb portion in the recognizable shape of a teddy bear.
Figure 8:
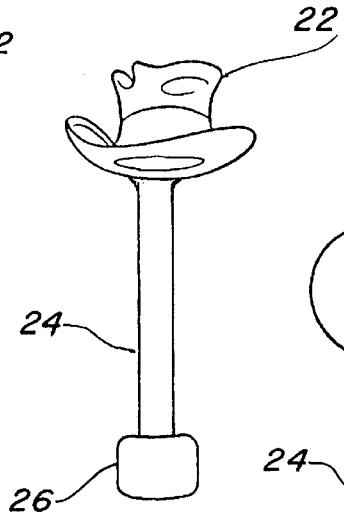
FIG. 8 is a front elevation view of the container with the bulb portion in the recognizable shape of a hat.
Figure 9:
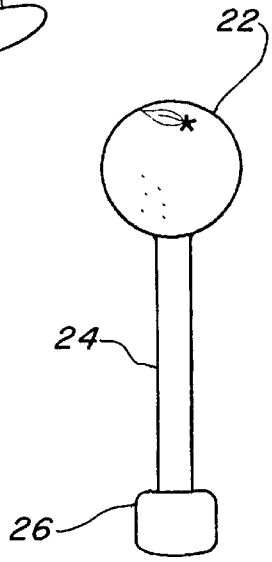
FIG. 9 is a front elevation view of the container with the bulb portion in the recognizable shape of an orange.
Figure 10:
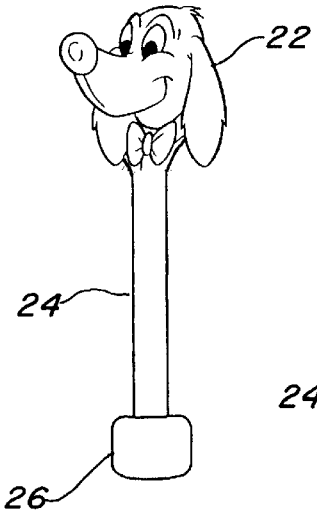
FIG. 10 is a front elevation view of the container with the bulb portion in the recognizable shape of a dog.
Figure 11:
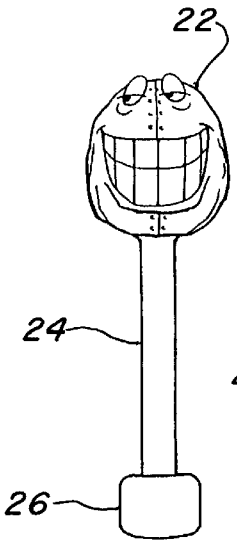
FIG. 11 is a front elevation view of the container with the bulb portion in the recognizable shape of a smiling face.
Figure 12:
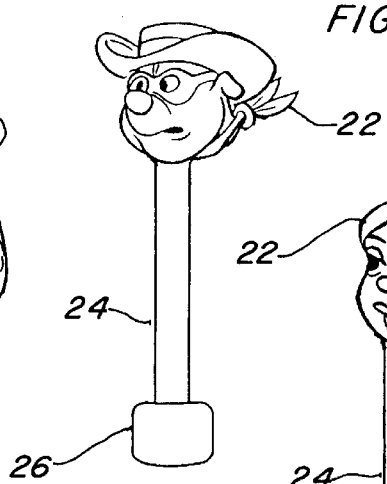
FIG. 12 is a front elevation view of the container with the bulb portion in the recognizable shape of a cowboy.
Figure 13:
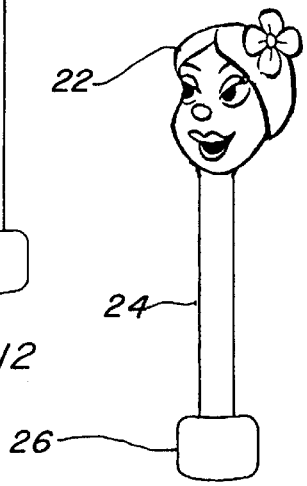
FIG. 13 is a front elevation view of the container with the bulb portion in the recognizable shape of a girl.

The container 20 has a recognizable shape on the bulb portion 22, which may be the conventional cylindrical shape with spherical ends common to eye droppers, as shown in FIGS. 1 and 2. Further, it may be in the shape of an animated character or in some form that is attractive to infants. FIGS. 6 through 13 illustrate just a few alternatives, such as FIG. 6, which is a front elevation view of the container 20 with the bulb portion 22 in the recognizable shape of a cat with whiskers. FIG. 7 illustrates the shape of a teddy bear, FIG. 8 depicts a hat shape, FIG. 9 the shape of an orange, FIG. 10 the head of a dog, FIG. 11 a smiling face, FIG. 12 the shape of a cowboy's head and FIG. 13 shows the head of a girl.

A metallic foil closure 30 is attached to the container's hollow stem 24 distal end for sealing the liquid medication 28 that is inside the container 20. This closure 30 may be attached with adhesive or some other method known in the art. The composition of the metallic foil closure 30 is preferably aluminum foil, however thermoplastic or other materials may be used with equal ease and dispatch. This aluminum foil cover 30 further includes a narrow tab 32 extending outward from one side to permit removal of the cover by manually grasping the tab 32 and lifting up.

Figure 18:
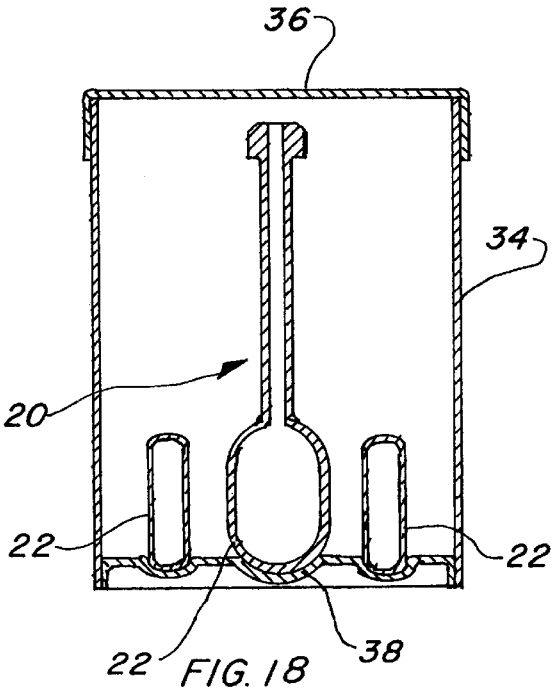
FIG. 18 is a cross sectional view taken along lines 18—18 of FIG. 17.
Figure 19:
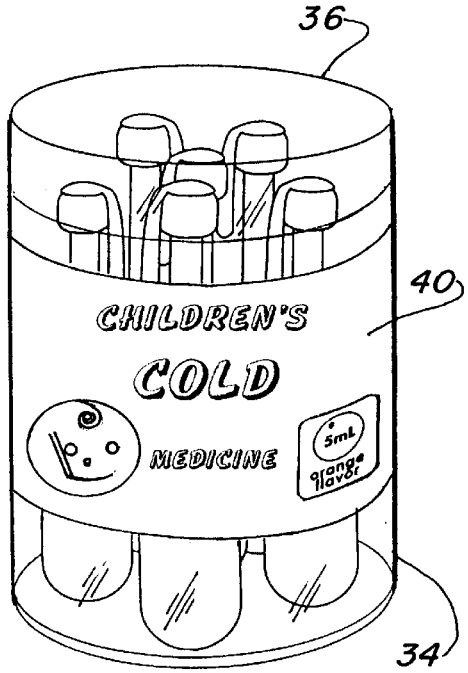
FIG. 19 is a partial isometric view of the canister with the containers inside with the label on the outside.

A transparent wide mouth canister 34 having a removable lid 36 is used for storage and conveyance of the pre-filled oral liquid containers 20. The canister 34 is sized to receive the appropriate number of containers according to the type of oral medication and dosage required. The canister 34 may be flat on the bottom or contain indentations 38, as illustrated in FIG. 18, for spacing the containers 20 apart.

Figure 14:
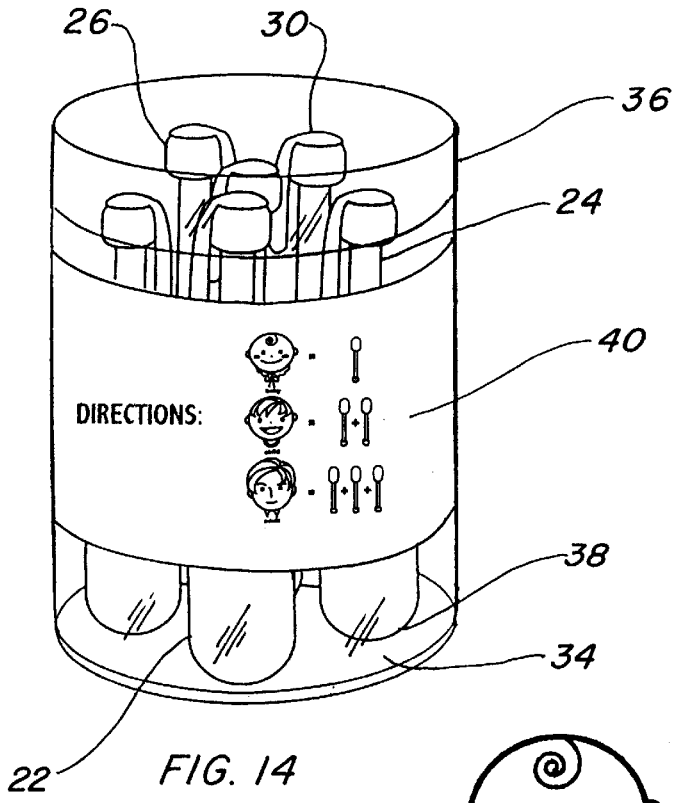
FIG. 14 is a partial isometric view of the containers within a wide mouth transparent canister.
Figure 15:
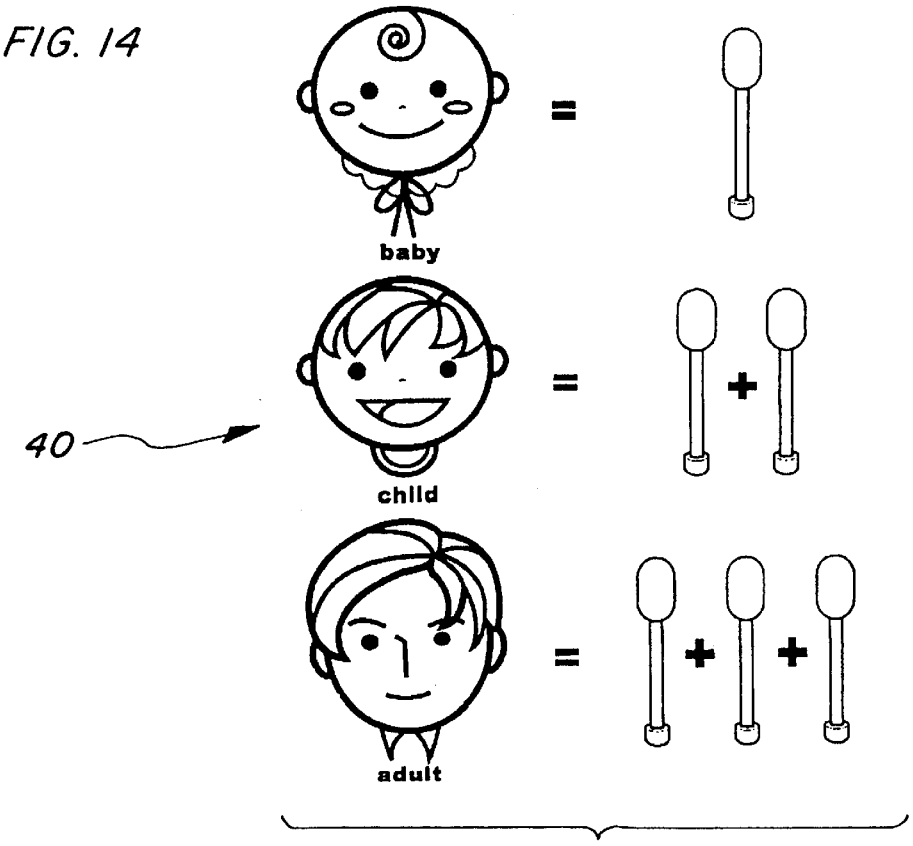
FIG. 15 the diagrammatic labeling for the canister completely separate from the invention.
Figure 16:
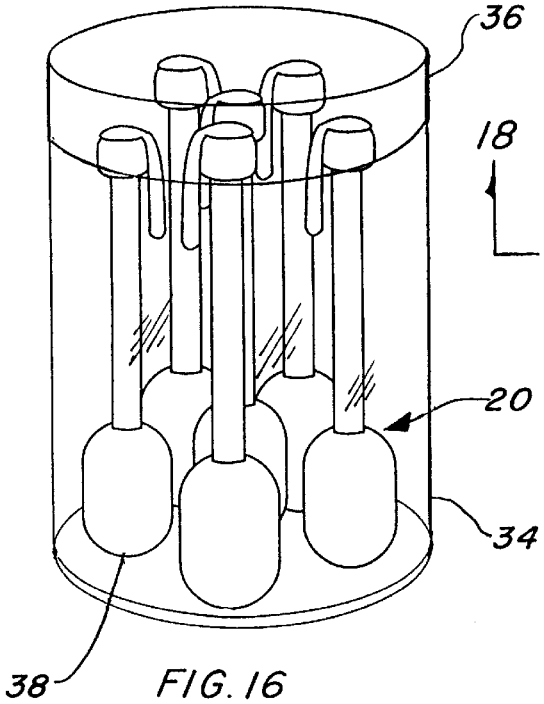
FIG. 16 is a partial isometric view of the canister with the containers inside less the label on the outside.
Figure 17:
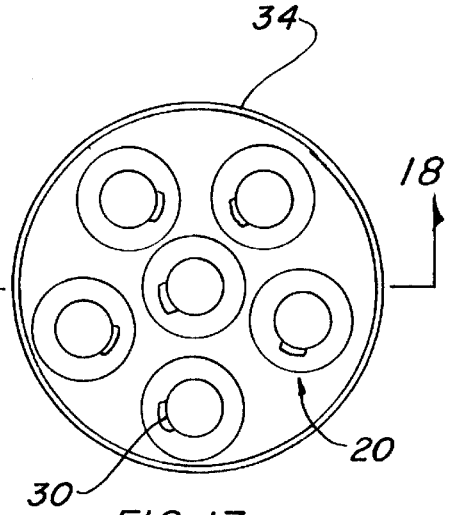
FIG. 17 is a top view of the canister with the containers stored inside.

A diagrammatic label 40 is directly printed, embossed, printed on pressure sensitive backed paper, silk screened or attached in some other manner to the outer surface of the canister 34 for indicating in a pictogram form the proper dosage of the oral liquid medication 28 within the containers 20. This indicia is illustrated in FIGS. 14 and 15 and greatly simplifies the directions required to take the medication.

During use, a medical practitioner or caregiver removes the appropriate number of containers 20 from the canister 34 according to the dosage indicated on the label 40. The metallic foil closure 30 is removed by pulling on the tab 32, and then the stem portion 24 of the container 20 is placed into the patient's mouth. The bulb portion 22 is then squeezed together, thus ejecting the liquid medication 28 directly into the patient's mouth. The empty container 20 and tab closure 30 may then be disposed of, along with other waste matter.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A pre-filled, oral liquid disposable plastic container and storage means comprising:

a) a plastic container having a hollow bulb portion and a hollow stem portion, b) a bulbous flange integrally formed onto said hollow stem distal end, thus permitting comfortable insertion into a patient's mouth, c) a specified quantity of liquid medication disposed within the container, d) said container having a color indicating the type of liquid medication contained within, e) said container having a recognizable shape on the bulb portion, and f) a metallic foil closure attached to the container hollow stem distal end for sealing the liquid medication within.

2. The pre-filled oral liquid disposable plastic container as recited in claim 1 wherein said plastic container further comprises a resilient pipette.

3. The pre-filled oral liquid disposable plastic container as recited in claim 1 wherein said plastic container further comprises an eye dropper.

4. The pre-filled oral liquid disposable plastic container as recited in claim 1 wherein said container is constructed of a thermoplastic material selected from a group consisting of polycarbonate, polyethylene, polyester, polystyrene, polypropylene, polysulfone, polyurethane, and ethylene-vinyl-acetate.

5. The pre-filled oral liquid disposable plastic container as recited in claim 1 wherein said bulbous flange having smooth radial corners to prevent injury when inserted into a patient's mouth.

6. The pre-filled oral liquid disposable plastic container as recited in claim 1 wherein said container color indicating the type of liquid medication contained within further comprises a color representing a specific medication, thereby permitting the medication within the container to be colorless and yet recognizable by the user.

7. The pre-filled oral liquid disposable plastic container as recited in claim 1 wherein said container having a recognizable shape on the bulb portion further comprises a cylindrical shape with spherical ends.

8. The pre-filled oral liquid disposable plastic container as recited in claim 1 wherein said container recognizable shape on the bulb portion further comprises an animated character shape.

9. The pre-filled oral liquid disposable plastic container as recited in claim 1 wherein said container recognizable shape on the bulb portion further comprises a form attractive to infants.

10. The pre-filled oral liquid disposable plastic container as recited in claim 1 wherein said metallic foil closure further comprises an aluminum foil cover.

11. The pre-filled oral liquid disposable plastic container as recited in claim 10 wherein said aluminum foil cover further comprises a narrow tab extending outward from one side to permit removal of the cover by manually grasping the tab and lifting up.

12. The storage means for the pre-filled oral liquid disposable plastic container as recited in claim 1 further comprising, a transparent wide-mouth canister having a removable lid and a plurality of containers disposed in the canister for storage and conveyance of the pre-filled oral liquid containers.

13. The storage means for the pre-filled oral liquid disposable plastic container as recited in claim 12 further comprising a diagrammatic label on the canister's outer surface for indicating in a pictogram form the proper dosage of the oral liquid medication within the containers.

* * * * *